United States Patent [19]

Hauser

[11] 4,242,830

[45] Jan. 6, 1981

[54] THREE DIMENSIONAL LIMBED DOLL

[76] Inventor: Maria T. Hauser, Frühlingstrasse 8, D-8216 Reit im Winkl, Fed. Rep. of Germany

[21] Appl. No.: 27,168

[22] Filed: Apr. 4, 1979

[30] Foreign Application Priority Data

Apr. 4, 1978 [DE] Fed. Rep. of Germany ..... 2814473

[51] Int. Cl.[3] ..... A63H 3/20

[52] U.S. Cl. ..... 46/161; 46/159; 46/173; 46/163

[58] Field of Search ..... 46/156, 158, 159, 160, 46/161, 162, 163, 173; 3/1 NQ

[56] References Cited

U.S. PATENT DOCUMENTS 2,846,810 8/1958 Ory ..... 46/161

3,462,877 8/1969 Lang ..... 46/161

3,555,723 1/1971 Kopsch et al. ..... 46/161

FOREIGN PATENT DOCUMENTS 2504737 2/1975 Fed. Rep. of Germany .

*Primary Examiner*—Robert A. Hafer

*Attorney, Agent, or Firm*—Albert F. Kronman

[57] ABSTRACT

The invention relates to a doll having movable jointed body parts, comprising a main body portion and limb portions, said limb portions being preformed individually, a body-shaped covering bag of air and fluid-tight material, joint regions between the limb parts being formed by the juxta-position of the limb parts within appropriate portions of said bag which holds the limb parts in their correct relationship with each other, and a fluid filling means introduced between the body and limb portions and the covering bag. If desired, the filling means may be a liquid, which is colored blood red.

7 Claims, 2 Drawing Figures

THREE DIMENSIONAL LIMBED DOLL

BACKGROUND OF INVENTION

The invention relates to dolls having movable joints formed between a main body portion of the doll and limbs thereof, the separate component parts being linkable together, and a resilient outer skin covering at least the joints and holding these in position.

This type of doll is known from German Pat. Specification No. 1603608. The substantially rigid component limbs are however not entirely covered with a general coating. Apart from that, the known dolls with movable joints feel hard to the touch because of the rigidity of the component parts, so that there is a certain unnaturalness because of the stability to pressure.

In German Pat. Specification No. 2504737 is disclosed a doll with movable joints, which has no cover but whose component parts are sealed in a water-tight manner. Flanges provided on the body and corresponding cut-back portions on the limbs are tightly sealed by sliding partitioning means lying one upon the other. The latter are provided with sealable inlets so that water is prevented from penetrating from possible bathing of the doll. Since with this doll, it is a question of an entirely different type of jointing assembly, the question of liquid-or gas-tight filling means does not arise.

BRIEF DESCRIPTION OF INVENTION

The invention sets out basically to provide a doll of the above-mentioned kind which additionally exhibits a greater degree of realism because of its resilience under applied pressure. The problem is solved according to the invention by providing the doll with a liquid-tight and/or gas-tight covering skin in the form of a bag and providing between the covering skin and the component body parts (the main body porton, upper arm, lower arm, thigh, lower leg) a gaseous or liquid filling means.

According to a preferred example the gaseous means is under a slight pressure for example 0.5 atmospheres above atmospheric pressure. The liquid medium may be water or an oil-like substance.

In this latter case, the space between the covering and the body parts is not entirely filled with the liquid medium.

Suitably, the liquid medium is blood-red in colour.

BRIEF DESCRIPTION OF DRAWINGS

An example of a doll according to the invention will now be described with reference to the accompanying drawings, in which.

DETAILED DESCRIPTION OF DRAWINGS

Figure 1:
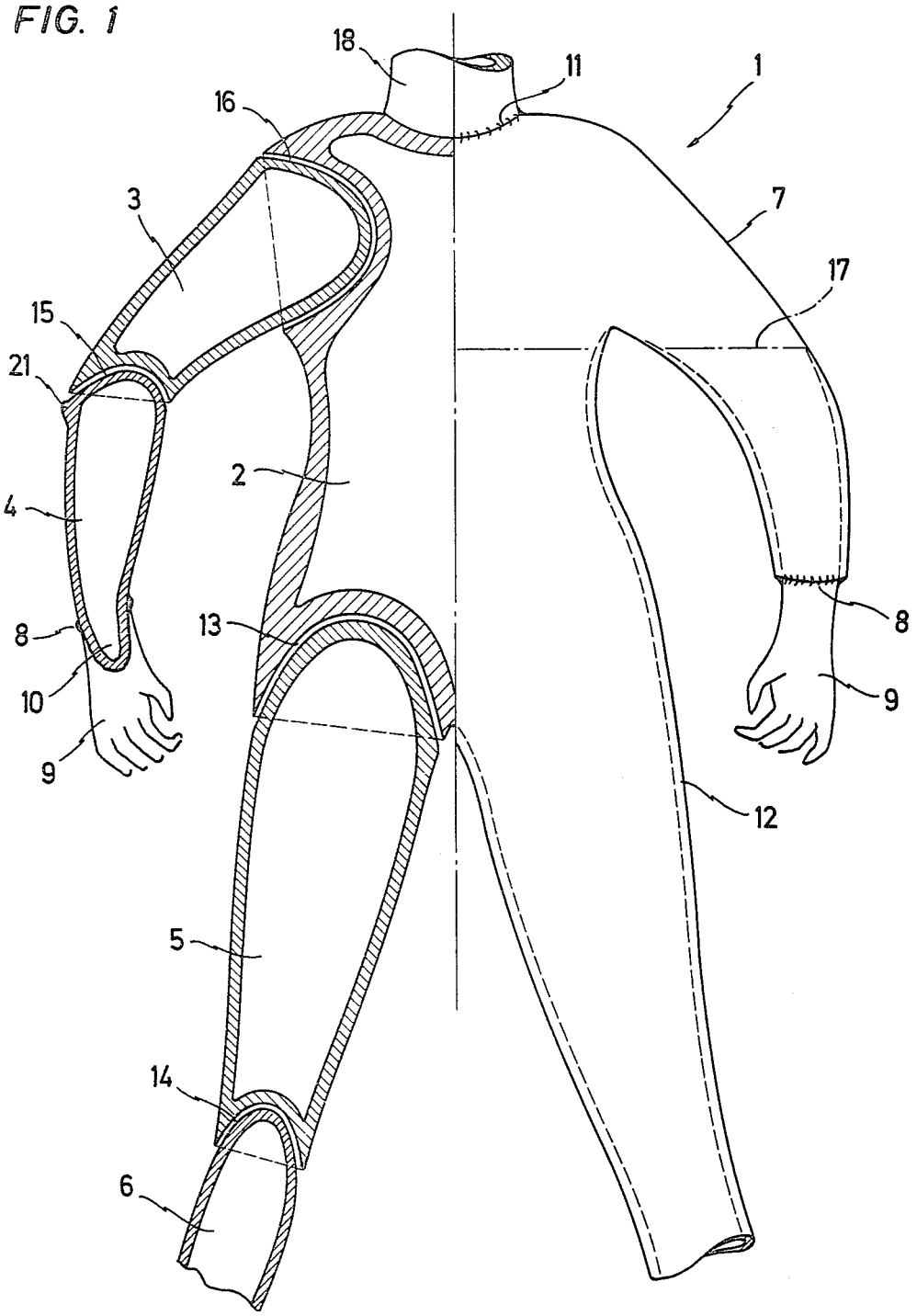
FIG. 1 shows a front elevational view of the example, partly in section.

A doll, 1 with movable joints and composed of individual, pre-formed component parts has a body portion 2, upper arms 3, forearms 4, thighs 5 and lower legs 6.

The individual components are and-and/or gas-tight hollow members made from a rigid material, for example, synthetic polyamide. In another example the rigid body or individual parts may be formed as solid components, in which case the surface is correspondingly unyielding. A slight amount of pliability in the surface of the individual component parts may be found advantageous.

A covering skin 7 which is, for example, made from thin gauge polyvinylchloride, is formed in a one-piece body-shaped bag and is stretched over all the component parts except the head, hands and feet. These latter parts are made in a conventional manner from polyvinylchloride which is slightly softer in comparison to the component parts.

In another example, the hands 9 and the feet are provided with the skin covering, in which case it is not necessary to provide water-or air-tight welded seams (such as are indicated at 8) or other sealing means. However, in the present case the forearms 4 or the lower legs 6 enter the covering skin in such a way that projections 10 engage with the inside of the hand parts 9. Projections on the lower legs engage in the foot parts. After the other parts, including the head (not shown), are inserted, the seams 8 and 11 are welded, as well as the corresponding seam at the feet. Finally the back seam is closed and at this point an oil-like substance is poured into the space between the individual body parts and the covering skin. If the welding seam at the head is left open, the back seam being already closed, the oil-like substance may be poured into the still-open neck seam.

The oil-like substance 12 not only fills the space between the skin 7 and the external surfaces of the individual component parts, but also settles in the spaces 13, 14 and 15 and forms a kind of lubrication at those regions.

The entire space is not filled to bulging point with liquid, but only to the liquid level 17 as the doll is in a standing position, so that for example the joint 16 between the upper arm 3 and the body portion 2 is basically fluid-free. When the doll is laid down or topples over, then the region of the joint 16 is thus immersed.

Figure 2:
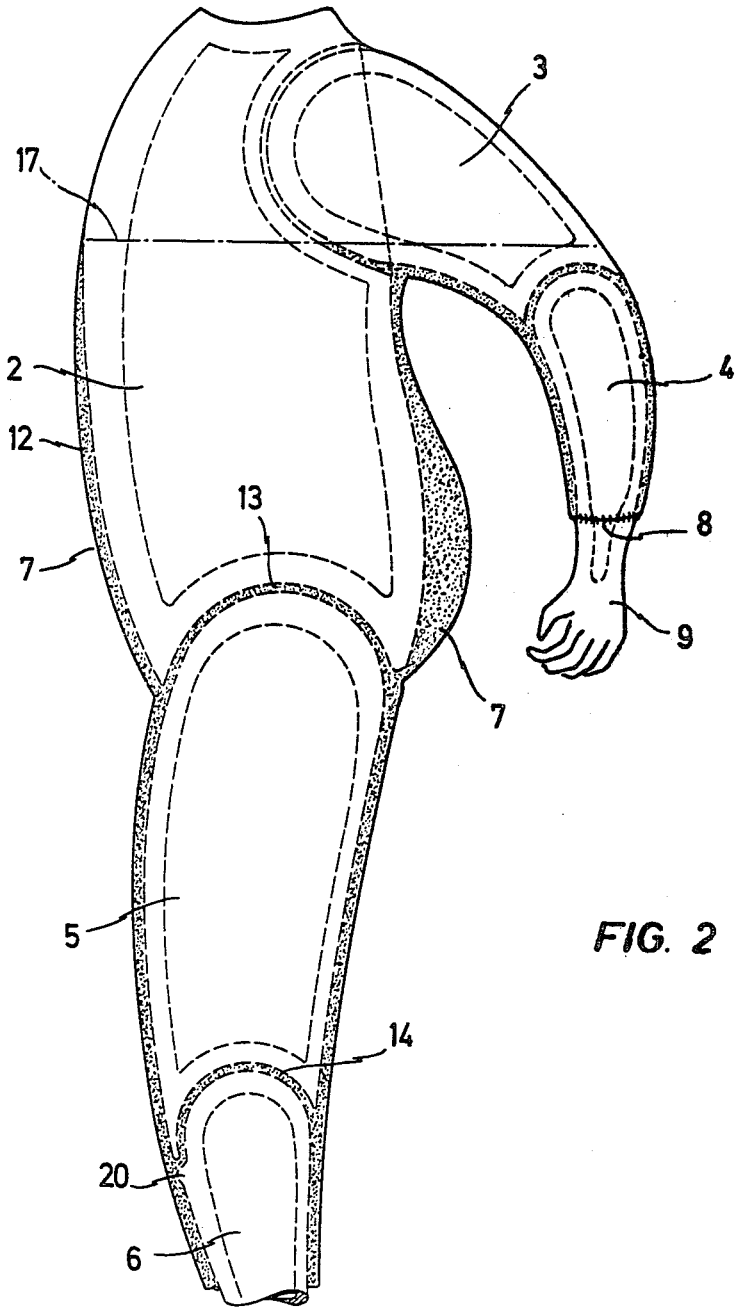
FIG. 2 shows a side view of the same example.

The head part 18 (not shown in full) may be held inmovable in the skin 7. The head may have a conventional wig. In order to make the head part air-and water-tight the individual hair strand openings may be sealed from the inside or sealed in some other way. As may be seen from FIG. 2, the skin 7 is relatively looser in the seat region across the body part, so that an appreciably larger amount of fluid is provided in this region between the skin and the body part. It is thus taken care of to maintain the full extent of the joint mobility of the thigh and to prevent the skin being overstretched.

Instead of filling the space between the individual body parts and the skin with water or an oil-like substance, it may be filled with air, for example at a pressure of 0.5 atmosphere above atmospheric pressure.

In this way, not only is a plump filling achieved in the skin, but the individual component parts remain movable with the minimum amount of friction between them.

The component parts, for example the lower leg 6, are provided with stop ridges 20 to prevent the individual limb or body part from partaking of an unnatural movement. Corresponding projections 21 are shown in this example on the forearm.

The selected liquid or oil substance may be provided with a blood red colour. If then a child at play pricks the doll or otherwise damages it, it produces this natural-looking liquid. The opening thus occurring may be closed again by a waterproof sticking plaster.

It should be further mentioned that a doll which is emptied of the compressed air or the liquid remains fully functional. The lack of lubrication may then result in the individual body parts remaining in the angular position in which they were physically placed, and they may only be brought back to their original position by manual action.

I claim:

1. A doll having movable jointed air and fluid-tight body parts comprising a main body part and limb parts, the latter being preformed individually, a one piece body-shaped covering bag of air and fluid-tight material defining generally the final outline of said doll, joint regions between said limb parts being formed by a juxta-position of said limb parts within appropriate portions of said bag which alone holds said limb parts in their correct pivoted relationship with each other, and a fluid filling means introduced into the space between said body and limb parts and said covering bag.

2. A doll as claimed in claim 1, wherein said fluid filling means is compressed air.

3. A doll as claimed in claim 2, wherein said air is at 0.5 atmospheres above pressure.

4. A doll as claimed in claim 1 wherein said fluid filling means is water.

5. A doll as claimed in claim 1 wherein said fluid filling means is an oil.

6. A doll as claimed in claim 1 wherein said filling means is a liquid which does not completely fill available space between said body parts and said limb parts and said covering bag.

7. A doll as claimed in claim 1 wherein said filling means is a liquid which has a blood-red color.

* * * * *